United States Patent [19]

Naruse

[11] Patent Number: 4,785,640

[45] Date of Patent: Nov. 22, 1988

[54] FREEZING APPARATUS USING A ROTARY COMPRESSOR

[75] Inventor: Nobutaka Naruse, Toyoake, Japan

[73] Assignee: Hoshizaki Electric Co., Ltd., Toyoake, Japan

[21] Appl. No.: 59,855

[22] Filed: Jun. 1, 1987

[51] Int. Cl.[4] ..... F25B 41/00

[52] U.S. Cl. ..... 62/196.4; 62/277

[58] Field of Search ..... 62/81, 196.4, 156, 277, 62/352, DIG. 17

[56] References Cited

U.S. PATENT DOCUMENTS 2,344,215 3/1944 Soling et al. ..... 62/196.4

3,097,503 7/1963 Liebermann ..... 62/196.4

3,498,073 3/1970 Kusuda et al. ..... 62/196.4

*Primary Examiner*—William E. Wayner

*Attorney, Agent, or Firm*—Wenderoth, Lind & Ponack

[57] ABSTRACT

A refrigerating apparatus includes a compressor, a condenser, a capillary and an evaporator. A bypass conduit with a valve is arranged so that the refrigerant discharged from the compressor will bypass at least the condenser and the capillary so as to return to the inlet side of the compressor. The pressure or the temperature of the refrigerant in the apparatus is sensed by a sensor. When the sensed value is less than a prescribed value, the valve is opened to return the hot gas to the compressor. The compressor is driven for elevating its temperature.

6 Claims, 2 Drawing Sheets

FREEZING APPARATUS USING A ROTARY COMPRESSOR

BACKGROUND OF THE INVENTION

1. Field of the Invention

This invention relates to a freezing apparatus and, more particularly, to a novel improvement for increasing the freezing efficiency of a rotary compressor employed in the freezing apparatus.

2. Description of the Prior Art

Heretofore, reciprocating compressors were generally used in freezing units such as refrigerators or ice making machines. Recently, however, the use of rotary compressors has also been suggested as a way to save space in such devices.

It is generally known that, in a rotary compressor, the inside of the shell thereof is maintained at a relatively high pressure, so that the lubricating oil is charged at the high pressure side, and that, when the compressor is at a standstill, the refrigerant is mixed into the compressor oil. When the compressor is started with the refrigerant thus mixed into the oil, the refrigerant remains in the oil since the pressure in the oil chamber of the compressor is not lowered contrary to conventional reciprocating compressors. The result is that a shortage in the amount of refrigerant circulated through the refrigerant system occurs and increases in pressure at the high pressure side are not achieved smoothly. The effect of the shortage of refrigerant is more pronounced in a compressor charged with only a limited amount of refrigerant. Thus, since it is difficult to increase the pressure at the high pressure side in this manner, the pressure at the low pressure side becomes extremely low and a vacuum running phenomenon occurs in which the amount of the refrigerant in circulation is significantly reduced.

One of the reasons why the pressure increase at the high pressure side of the compressor is retarded is that the compressor at ambient temperature acts to cool the refrigerant due to its large thermal capacity and because heat radiation from the shell surface is also considerable due to the fact that the higher pressure side is in the compressor shell.

As a result of the above described phenomenon, the cooling properties at the beginning of the compressor starting operation will be lowered especially at lower ambient temperatures. This causes a refrigerating or ice making operation to be continued for an extended time, so that energy loss is correspondingly increased. For example, when the ice making machine performs the ice making operation in the above-described condition, the shape of the ice product(s) formed on the freezing mold at the inlet side of the evaporator may differ considerably from that of the ice products at the outlet side of the evaporator. The reason for this is that the pressure at the low pressure side becomes unusually low from the time the ice starts, the temperature at the inlet of the evaporator or the vaporization temperature being extremely low, and the temperature at the outlet side not being significantly lowered, thus resulting in an undesirable temperature balance between the inlet and the outlet of the evaporator.

The above-described phenomenon will become more pronounced when a lower ambient temperature prevails about the ice making machine. However, the same phenomenon occurs from time to time at a room temperature of about 10° C., which temperature is in excess of the sensing temperature (4° C. to 8° C.) of the defrosting or harvesting completion sensor thermostat so far used as means for sensing the completion of the harvesting cycle. The above-described problem, due to the undesirable temperature balance, cannot be solved even when the harvesting cycle start is controlled by a conventional control system. That is, when the harvesting thermostat is set to a higher temperature, the harvesting operation is protracted even during normal operation thus causing a loss in time. On the other hand, the pressure at the low pressure side during harvesting may be occasionally increased to an unusual value so that problems with respect to the durability of the compressor occur.

An advantageous feature of the rotary compressor is that it is lighter and more compact than a reciprocating compressor. However, its small thermal capacity resulting from its lightness proves to be a disadvantage when employed in an ice making machine using hot gas for defrosting. More specifically, during the defrosting cycle of the ice making machine, the ice formed by an evaporator is detached from the freezing mold by heating. During this defrosting cycle, the refrigerant gas is condensed and turned into a refrigerant liquid which is sucked in a large quantity into the compressor resulting in the cooling of the compressor. The rotary compressor having a smaller thermal capacity than the conventional reciprocating compressor is cooled more quickly than the reciprocating compressor. This indicates that the rotary compressor has an extremely low hot gas effectiveness as compared to the reciprocating compressor thus markedly affecting the defrosting ability at the lower temperature of the rotary compressor.

SUMMARY OF THE INVENTION

It is a principal object of the present invention to provide a freezing apparatus free of the aforementioned deficiencies of the prior-art apparatus.

It is another object of the present invention to provide a freezing apparatus exhibiting an improved cooling performance at the initial stage of the freezing operation.

It is a further object of the present invention to provide an ice making machine wherein the shape of the ice products is not markedly different at the inlet and outlet sides of the evaporator at the initial ice making cycle at lower temperatures, and wherein the initial ice making cycle may be terminated within a reasonably shorter time interval to thus improve the energy efficiency thereof.

According to the present invention, there is provided a freezing apparatus comprising a closed loop freezing circuit including a compressor having a refrigerant outlet and a refrigerant inlet, said closed loop circuit also including a condenser, expansion means and an evaporator disposed sequentially from said refrigerant outlet towards said refrigerant inlet, and a bypass conduit having one end connected to said closed loop circuit between the outlet side of said compressor and the inlet side of said condenser and having the other end connected to said closed loop circuit between the outlet side of said expansion means and the inlet side of said evaporator, said bypass conduit including first valve means, characterized in that the freezing apparatus further comprises a sensor for sensing the temperature or the pressure of the refrigerant in said closed loop circuit, and control means connected to said sensor to control the opening and closing of said first valve means in said bypass conduit in such a manner that, when the temperature or the pressure sensed by the sensor is below a prescribed value, the cooling operation of the freezing apparatus is effected only after the first valve means in said bypass conduit is opened and the compressor is actuated for elevating its temperature.

BRIEF DESCRIPTION OF THE DRAWINGS

In the course of the following detailed description, reference will be made to the attached drawings in which the same reference numerals denote the same or similar parts in the several figures and in which.

DESCRIPTION OF THE PREFERRED EMBODIMENTS

Figure 1:
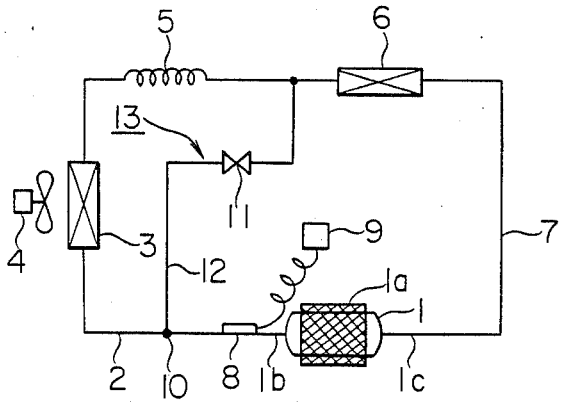
FIG. 1 is a diagrammatic view showing a freezing circuit of the freezing apparatus according to a first embodiment of the present invention.
Figure 2:
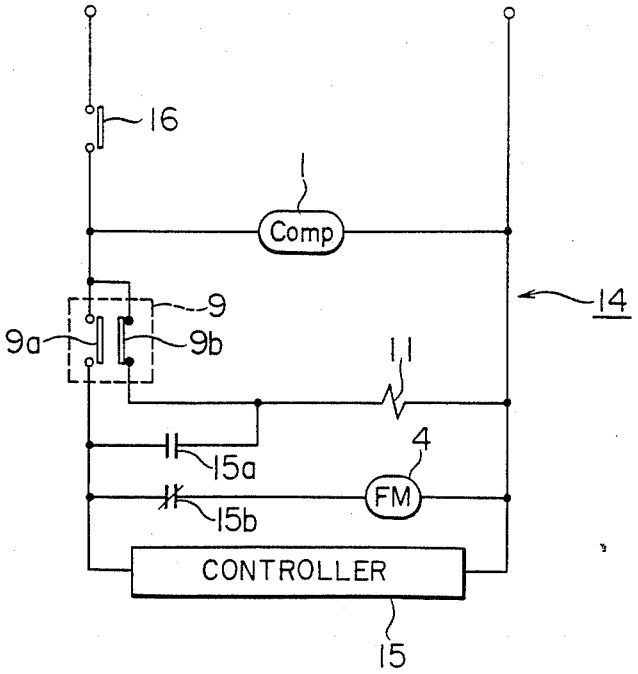
FIG. 2 is a connection diagram of the freezing circuit shown in FIG. 1.

Referring to the drawings, and more particularly to FIG. 1, there is shown a freezing circuit according to a preferred embodiment of a freezing apparatus using a well-known rotary compressor, and FIG. 2 shows its control circuit. The numeral 1 denotes the rotary compressor having an insulating layer 1*a* on its outer surface. The compressor 1 has its outlet side 1*b* connected through a first pipe section 2 to a condenser 3 associated with a cooling fan 4 while the condenser 3 is connected through a capillary 5 and an evaporator 6 to an inlet side 1C of the compressor 1 by way of a second pipe section 7. If necessary, a well-known accumulator, not shown, may be provided at the inlet side of the compressor 1. The compressor 1, condenser 3, capillary 5 and the evaporator 6 are connected in sequentially in this order to comprise a closed loop circuit through which the freezing medium or refrigerant circulates, via the first and second pipe sections 2 and 7, in a direction of freezing medium flow through these sections.

A hot gas conduit 12 having a hot gas valve 11 has one end connected to a junction 10 provided in the first pipe section 2 between the output side 1*b* of the compressor 1 and the inlet side of the condenser 3. The hot gas conduit 12 has its other end connected to the second pipe section 7 between the output side of the capillary 5 and the inlet side of the evaporator 6. This hot gas conduit 12 comprises a bypass circuit 13 for supplying the freezing medium exiting from the compressor 1 directly to the evaporator 6.

A well-known type sensor 8 is provided in the first high pressure pipe section 2 upstream of the junction 10 with respect to the direction of the flow of the freezing medium and in the vicinity of the outlet side 1*b*, and the sensor 8 is connected to a switch 9 that may be a thermostat, an electronic temperature switch or a pressure switch. This sensor 8 senses the temperature or the pressure of the gaseous freezing medium and the switch 9 is actuated depending upon the sensed value of the temperature or pressure for controlling the hot gas valve 11, as described later.

The switch 9 is provided in a control circuit 14 shown in FIG. 2 and has first and second contacts 9*a* and 9*b*. The first contact 9*a* of the switch 9 is connected to a well-known type controller 15 for an ice making machine, and is also connected to a normally open contact 15*a* and a normally closed contact 15*b*, both being controlled by the controller 15. The contact 15*a* is serially connected to the hot gas valve 11, while the contact 15*b* is serially connected to the cooling fan 4. The second contact 9*b* of the switch 9 is serially connected to the hot gas valve 11 while the compressor 1 is connected to an electrical power source by way of an ice storage switch 16 sensing the quantity of ice contained in an ice stocker of the ice making machine, not shown.

During operation, when the ice storage switch 16 senses that the ice quantity in the ice stocker falls short of a prescribed amount, the switch 16 is turned on, so that the compressor 1 begins operating. The operation of the compressor is continued until the ice storage switch 16 is turned off. When the temperature and/or the pressure of the freezing medium as sensed by the sensor 8 associated with the switch 9 is in excess of a predetermined value, for example a temperature of 50° C. to 60° C., the second contact 9*b* is turned off to close the hot gas valve 11, while the first contact 9*a* is turned on to supply current to the controller 15 of the ice making machine, so that the usual freezing cycle is continued. However, when the temperature or the pressure sensed by the sensor 8 is lower than the preset value, the hot gas valve 11 is opened to open the first bypass circuit 13 so that the operation is switched to a bypass operation in which the hot gas is supplied from the compressor 1 to the evaporator 6 through the hot gas valve 11.

During this bypass operation, which is a hot gas cycle operation for the freezer and a defrosting or harvesting cycle operation for the ice making machine, the cooling fan 4 adapted to cool the condenser 3 is at a standstill. It is noted that, during the bypass operation, the compressor 1 as a whole becomes heated due to the heat from the compressor motor and due to the compression process of the freezing gas, and therefore the temperature of the compressor 1 is effectively increased, this increase being prolonged by the thermal insulation of the insulator 1*a*. The reason for this is that, since the hot gas valve 11 is now opened, the quantity of the cooling medium flowing through the bypass is larger than that when flowing in the capillary 5 so that the work load of the compressor 1 is also increased.

Hence, with the increase in the temperature of the compressor 1, the temperature or the pressure of the gaseous freezing medium is increased. When the temperature or the pressure sensed by the sensor 8 exceeds the prescribed value, the first and second contacts 9*a*, 9*b* of the switch 9 are turned on and off, respectively, for reinitiating the freezing cycle. At the time of initiation of the freezing cycle, the freezing medium is at its normal elevated pressure, so that ice having the desired shape may be produced right at the beginning of the freezing cycle.

Although the sensor is provided in the present embodiment at the high pressure side of the freezing circuit, a similar effect may be attained when the sensor is provided at the low pressure side for sensing the temperature or pressure of the freezing medium flowing through the circuit.

Figure 3:
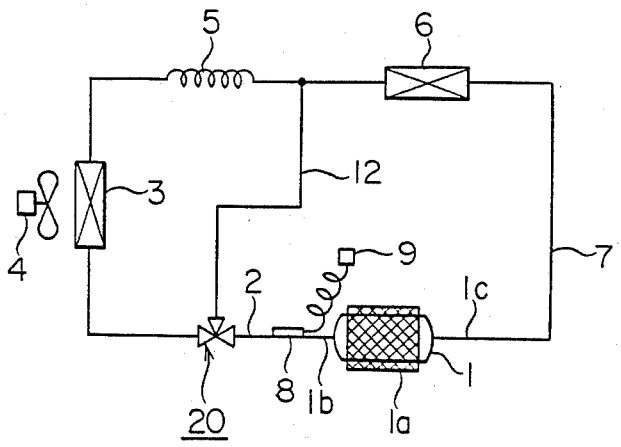
FIG. 3 is a diagrammatic view showing a freezing circuit of the freezing apparatus according to a third embodiment.

FIG. 3 shows a further modification of the present invention. The present modification is also similar to the embodiment shown in FIG. 1 except that a well-known three-way valve 20 is used instead of the hot gas valve 11, which is provided at the junction 10 between the first pipe section 2 and the bypass conduit 12. When one of the flow channels of the three-way valve 20 is opened for establishing communication between the outlet side 1*b* of the compressor 1 and the bypass conduit 12, the other flow channel is closed for interrupting communication of the gaseous refrigerant or freezing medium from the compressor 1 towards the condenser 3. In the reverse case, the other flow channel is opened. In the present embodiment, the flow of the refrigerant gas into the condenser 3, where the volume of heat radiation is at the maximum at the high pressure side of the freezing device, is inhibited during the bypass operation, the refrigerant gas being liquefied in the condenser 3 when the pressure or the temperature in the condenser 3 is lower than the saturation pressure or temperature of the refrigerant. Thus, any remnant refrigerant in a portion of the first piping section 2 downstream of the condenser 3 and the three-way valve 20 is supplied to the evaporator 6 through capillary 5, such that almost all of the refrigerant may be utilized for the bypass operation, resulting in that the time necessary for elevating the temperature of the compressor 1 is further reduced. It is therefore possible to compensate for the lesser heat volume of the compressor while avoiding situations such as those resulting in incapacitated harvesting during the normal operating cycle, the prolongation of the harvesting time with resulting over-melting of ice products, or excess energy consumption.

Figure 4:
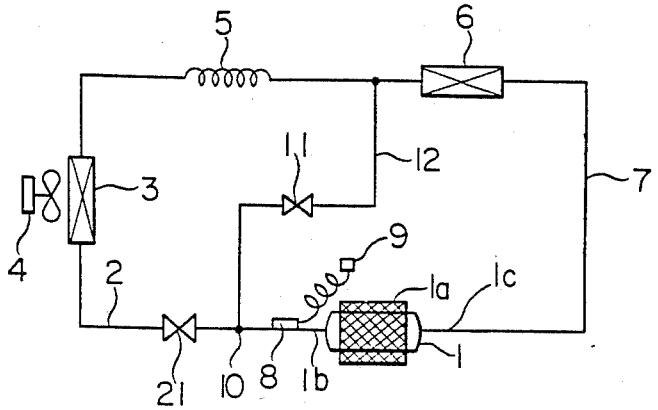
FIG. 4 is a diagrammatic view showing a freezing circuit of the freezing apparatus according to a fourth embodiment.
Figure 5:
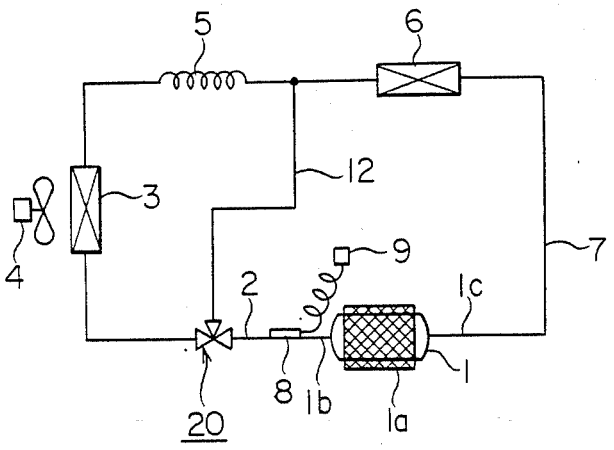
Figure 6:
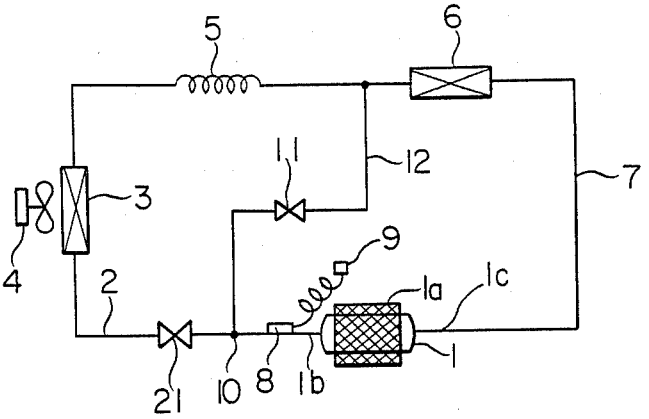

FIG. 4 shows a further modification of the present invention. The present modification differs from the embodiment shown in FIG. 1 only in that a separate valve 21 is provided in the first pipe section 2 downstream of the junction 10. The valve 21 is closed and opened when the hot gas valve 11 is opened and closed, respectively, so that the operation is similar to that of the embodiment shown in FIG. 3.

With the above-described freezing apparatus making use of the rotary compressor according to the present invention, the compressor is heated rapidly even when the compressor is at ambient temperature and it is only after the shell temperature is increased that the freezing apparatus performs the ice making operation. The result is that higher pressure is substantially equivalent to the pressure during the rated operation thereof, while the lower pressure is not lowered excessively at the time of initiation of the freezing operation. With an ice making machine employing the present invention, the ice formed on the freezing plate has the same shape at both the inlet side and the outlet side of the evaporator so that ice products having a uniform shape and hence, a higher commercial value, may be produced within a normal ice making time from the first freezing cycle so that energy efficiency is improved. With a refrigerator, air conditioner or a vehicle air conditioner in which the teachings of the present invention are incorporated, the cooling effect is markedly improved due to the improved dehumidification, de-frosting or cooling at the initiation of the operation.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What I claim is:

1. In a freezing apparatus for performing a cooling operation, the apparatus having a closed loop freezing circuit through which refrigerant circulates in a refrigerant flow direction, the circuit including, in the following sequence with respect to said flow direction, a compressor operable for circulating the refrigerant in said flow direction to initiate said cooling operation, a refrigerant outlet of the compressor from which the refrigerant flows from the compressor, a condenser, an expansion means, an evaporator and a refrigerant inlet of the compressor through which the refrigerant flows to the compressor, the improvement comprising:

temperature elevation means for causing the temperature of the compressor to rise during the initiation of the cooling operation when the temperature of the refrigerant in the circuit prior to initiation of the cooling operation is below a predetermined value, said value being one at which the refrigerant is unsatisfactory in facilitating the cooling operation, to raise the temperature of the refrigerant during the initiation of the cooling operation to one above said predetermined value that is satisfactory to facilitate the cooling operation, said temperature elevation means comprising a bypass conduit connected at one end thereof to the freezing circuit between said refrigerant inlet of the compressor and said condenser and at the other end thereof to the freezing circuit between said expansion means and said evaporator, first valve means disposed in said bypass conduit and movable between a first position at which said bypass conduit is open and a second position at which said bypass conduit is closed, sensor means disposed at the outlet side of said compressor for sensing one of the pressure and the temperature of the refrigerant in the freezing circuit at the initiation of the cooling operation, and control means operatively connected between said sensor means and said first valve means for moving said first valve means from said second position to said first position when the value sensed by said sensor means during the initiation of the cooling operation is indicative that the temperature of the refrigerant is below said predetermined value thereby allowing the refrigerant circulated by the compressor to bypass said condenser and said expansion means.

2. An improved freezing apparatus as claimed in claim 1, wherein said compressor is a rotary compressor.

3. An improved freezing apparatus as claimed in claim 1, wherein said freezing apparatus is an ice making machine.

4. An improved freezing apparatus as claimed in claim 2, and further comprising insulating material covering the outer surface of said rotary compressor.

5. An improved freezer apparatus as claimed in claim 1, wherein said first valve means is a three-way valve operatively connected to said one end of said bypass conduit and said freezing circuit, said three-way valve including a first flow channel for allowing the refrigerant to flow from said compressor towards said bypass conduit when in said first position and a second flow channel for allowing the refrigerant to flow from said compressor toward said condenser when in said second position, said control means being operatively connected to said three-way valve for causing one of said flow channels to open when the other of said flow channels is closed.

6. An improved freezing apparatus as claimed in claim 1, and further comprising second valve means in said freezing circuit between the inlet of said condenser and the junction at which said one end of said bypass conduit is connected to said freezing circuit, said control means operatively connected to said first and second valve means for causing one of said first and second valve means to open when the other of said valve means is closed.

* * * * *